United States Patent [19]

Gisonni

[11] 4,149,456

[45] Apr. 17, 1979

[54] EGG PEELER

[76] Inventor: Thomas Gisonni, 19 Locust Dr., Thiells, N.Y. 10984

[21] Appl. No.: 863,896

[22] Filed: Dec. 23, 1977

[51] Int. Cl.[2] ..... A47J 17/00

[52] U.S. Cl. ..... 99/577; 30/120.1

[58] Field of Search ..... 99/568–583, 99/586–591; 30/120.1–120.5; 130/9 R

[56] References Cited

U.S. PATENT DOCUMENTS

| | | | |
|---|---|---|---|
| 1,030,324 | 6/1912 | Pender | 99/578 X |
| 1,137,841 | 5/1915 | Cookson | 99/591 X |
| 1,237,251 | 8/1917 | Lyng | 99/586 |
| 2,521,115 | 9/1950 | Calkins | 99/586 X |
| 2,752,966 | 7/1956 | Kisner | 30/120.1 |

*Primary Examiner*—Harvey C. Hornsby
*Assistant Examiner*—John M. Jillions
*Attorney, Agent, or Firm*—Wolder, Gross & Yavner

[57] ABSTRACT

A hard-boiled egg peeler, including a cylindrical housing defining sidewall openings through which prongs extend. The prongs are anchored at their outermost extent and protrude inwardly to a point proximate the center of the housing, terminating thereat in hook-like end portions. The prongs have a sufficient width and are in sufficient number to substantially retain the peeled egg shell after a hard-boiled egg is pushed through the cylinder, past the prongs and with its shell removed by the hook-like portions. Resilient material is placed between each prong and the inner sidewall of the housing to provide additional resilience to the prongs.

3 Claims, 4 Drawing Figures

EGG PEELER

This invention relates primarily to egg opening mechanisms and more particularly to egg opening mechanisms which are simple in their construction, and yet efficient in the accomplishment of their purpose.

One of the least attractive household chores is the peeling of a hard-boiled egg. Many attempts have been made to mechanize the process of peeling a hard-boiled egg. One example is described in U.S. Pat. No. 2,498,811, wherein a complex mechanism is in the form of an egg beater, wherein an egg is rotated by rubber bands and the shell is squeezed to crack it.

Another form of egg peeler is iluustrated in U.S. Pat. No. 1,097,283, wherein the egg is held while a cutting edge is pressed into the shell in order to separate the shell into two halves.

The above forms of egg openers or peelers are either extremely complex (the former) or more unsuitable for the intended purpose (the latter) than the present invention.

Other forms of egg peeling mechanism have been devised but suffer from the same drawbacks. Most are extremely complex for the purpose intended, and some simply do not improve over the old hand method of breaking and peeling the shell.

Accordingly, a primary function of the present invention is to provide an egg peeler which is simple, yet efficient in the accomplishment of its purpose.

A further object of the present invention is to provide a relatively simple mechanism by which the shell is peeled from a hard-boiled egg.

A still further object of the present invention is to provide a simple, hard-boiled egg peeler wherein the peeled shell is substantially retained in the device after its separation from the egg.

These and other objects of the present invention are accomplished in an egg peeling mechanism which features a cylindrical housing defining side wall openings through which a plurality of prongs extend. Prongs are anchored at their outermost extent and protrude inwardly to a point proximate the center of the housing. The prongs are flat, elongated and of a sufficiently springy material to avoid excessive pressure on the egg. Such prongs are of sufficient width and in sufficient number to substantially retain the peeled egg shell after a hard-boiled egg is pushed through the cylinder. The inward ends of the prongs comprise hook-like portions to grab and peel the egg shell as the egg moves by. Resilient material is placed between each prong and the inner sidewall of the housing, near the intersection thereof, in order to gently press the prongs towards the egg as it passes. The cap of the egg may be removed before insertion to the device in order to facilitate engagement of the hook-like end portions of the prongs with the egg shell. However, the device as described herein works almost equally satisfactory without the egg cap removed.

Other objects, features and advantages of the present invention will be apparent by the following more detailed description of the preferred, but nonetheless illustrative, embodiment of the present invention, with reference to the accompanying drawings, wherein.

Figure 2:
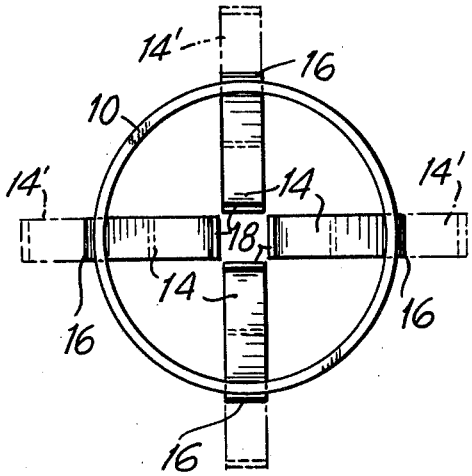
FIG. 2 is a top view taken along the line 2—2 of FIG. 1, showing particularly a four-prong array for engagement and peeling of an egg shell.

Referring to the drawings an egg peeler is shown to include a substantial cylindrical housing 10 defining sidewall openings 12 through which protrude a plurality of prongs 14. The prongs are elongated, substantially flat (FIG. 2) and terminate at their outward extent in an anchor bead 16 positioned outside of housing 10. The relative size of the openings 12 and the prongs 14 are such that prongs 14 may freely move in and out with respect to the housing as illustrated by ghost lines 14'. The other ends of prong 14 comprise hook-like portions 18, whose function will be more fully described hereinafter.

Between each prong 14 and housing 10 is placed a resilient cushion 20 to gently bias prongs 14 upwardly and toward the center of the cylindrical housing 10.

Figure 1:
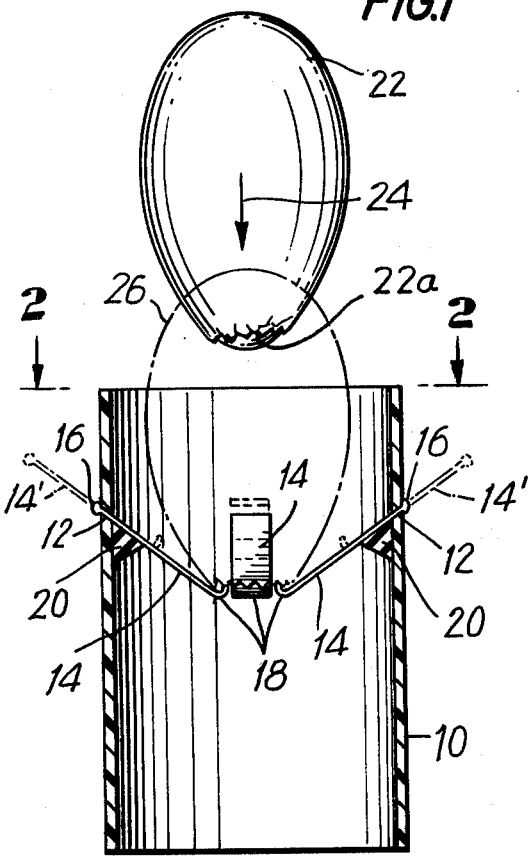
FIG. 1 is a front sectional view of an egg peeler according to the present invention, showing particularly the engagement of the prongs with the sidewall of the housing and the motion of the egg therethrough.

In order to provide greater understanding for the present invention, a series of operational steps will now be described with reference to hard-boiled egg 22. A recommended first step is to remove the egg shell at the cap **22*a* of egg 22 by conventional means (by hand). Egg 22 is then moved in a direction illustrated by arrow 24 in FIG. 1 downwardly into the cylindrical housing 10, so that it assumes the position depicted by ghost lines 26 in FIG. 1. At this point, hook-like end portions 18** engage the hard-boiled egg shell at the point where the cap was previous removed.

Figure 3:
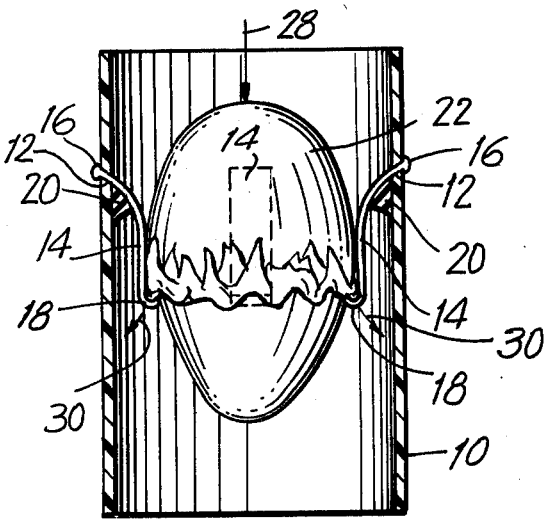
FIG. 3 is a view similar to that of FIG. 1 but showing the egg in the process of peeling by engagement of the hook-like end portions of the prongs.
Figure 4:
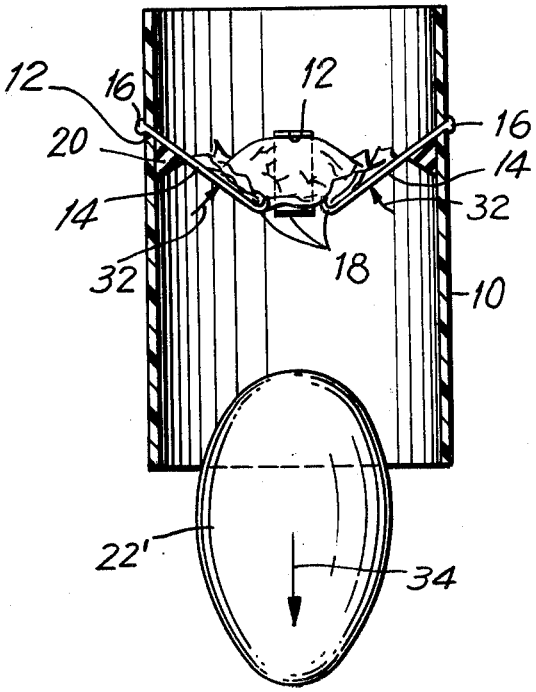
FIG. 4 is a view similar to that of FIG. 3, but showing the hard-boiled egg after peeling by the present invention with the egg shells therefrom being substantially retained above the prongs.

The egg is then moved further in a direction depicted by arrow 28 in FIG. 3 so that the hook-like end portions of prongs 14 continue to peel the egg shell as the egg moves downwardly. The pressure caused by the egg moving through the center of housing 10 is such that prongs 14 bend outwardly at their hook-like end portions, as shown by arrows 30 in FIG. 3. During this stage of the process, resilient cushions 20 bias prongs 14 towards the center of housing 10 such that upon completion of the egg's traverse through the housing (FIG. 4), prongs 14 return to their original position, as shown by arrows 32 in FIG. 4. It may also be seen from FIG. 4 that the peeled egg drops through the bottom of housing 10 in direction 34 with its shell completely removed. The broken shell may be seen in FIG. 4 as substantially retained above prongs 14, thus enabling easy removal and cleaning of the device.

The present invention thereby provides a clean, economical, simple, and yet efficient mechanism for the removal of an egg shell from a hard-boiled egg. The same operation is accomplished without removal of the egg shell cap prior to insertion of the egg through housing 10, due to the action of resilient cushions 20 in pressing prongs 14 toward the egg as it passes through housing 10.

The prongs may be of any one of a variety of materials, such as spring steel, stainless steel, or any material basically providing a springy action and resilience. The resilient cushions may be made of cork, rubber, polyethylene, or any one of a variety of materials to provide resilience and biasing of the prongs upwardly and inwardly with respect to the cylindrical housing. Also, the plurality of prongs may be of sufficient number to substantially enable a conical configuration for the group of prongs when viewed from above the cylindrical housing.

What is claimed is:

1. A hard-boiled egg peeler for peeling an egg in which one end portion of the shell has been removed comprising a cylindrical housing having a plurality of sidewall openings circumferentially spaced around said housing, a plurality of prongs loosely extending from the outside of said housing through said sidewall openings to substantially the center of said housing, said prongs having hook-like inward end portions that engage said egg shell at spaced points where said one end portion of the shell has been removed, and a resilient cushion fixed between said prongs and said sidewalls proximate said openings to resiliently bias said prongs upwardly and inwardly toward the center of said housing whereby the hook-like inward end portions of the prongs remove the remainder of said egg shell as said egg is forced downwardly through said housing.

2. The invention, according to claim 1, wherein said prongs include outer end beads for anchoring said prongs to said housing.

3. The invention, according to claim 1, wherein said prongs include an elongated, substantially flat configuration of a springy material.

* * * * *

UNITED STATES PATENT AND TRADEMARK OFFICE

CERTIFICATE OF CORRECTION

PATENT NO. : 4,149,456

DATED : April 17, 1979

INVENTOR(S) : THOMAS GISONNI

It is certified that error appears in the above-identified patent and that said Letters Patent are hereby corrected as shown below:

Claim 1, lines 2 and 10 (Column 3, line 7 and Colum 4, line 1) before "removed" add --cracked or--.

Signed and Sealed this

*Eleventh* Day of *September 1979*

[SEAL]

*Attest:*

*Attesting Officer*

LUTRELLE F. PARKER

*Acting Commissioner of Patents and Trademarks*